US007357387B2

(12) United States Patent
Asada

(10) Patent No.: US 7,357,387 B2
(45) Date of Patent: Apr. 15, 2008

(54) SHEET FEED DEVICE FOR FEEDING CUT SHEETS WHILE INTERPOSING SHORTENED INTERVAL BETWEEN SUCCESSIVE FED TWO SHEETS

(75) Inventor: Tetsuo Asada, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 353 days.

(21) Appl. No.: 10/695,827

(22) Filed: Oct. 30, 2003

(65) Prior Publication Data

US 2004/0089996 A1 May 13, 2004

(30) Foreign Application Priority Data

Oct. 31, 2002 (JP) ..... 2002-318438

(51) Int. Cl.
*B65H 7/08* (2006.01)

(52) U.S. Cl. ..... 271/110; 271/10.02; 271/10.03; 271/265.01

(58) Field of Classification Search ..... 271/10.02, 271/10.11, 10.03, 110, 265.01, 117, 118
See application file for complete search history.

(56) References Cited

U.S. PATENT DOCUMENTS 4,763,160 A * 8/1988 Honjo ..... 399/17
5,022,640 A * 6/1991 Greco, Jr. ..... 271/3.05
5,194,970 A * 3/1993 Iwanade ..... 358/498
5,228,680 A * 7/1993 Sugiura ..... 271/259
5,393,045 A * 2/1995 Fujimoto ..... 271/23
5,580,046 A * 12/1996 Beaufort et al. ..... 271/3.16
5,890,708 A * 4/1999 Song ..... 271/10.03
5,938,188 A * 8/1999 Nagahara ..... 271/121
5,947,465 A 9/1999 Kato et al.
5,964,460 A 10/1999 Azumi et al.
RE36,632 E * 3/2000 Iwanade ..... 358/498
6,224,049 B1 * 5/2001 Hosking et al. ..... 271/10.03
6,409,165 B1 * 6/2002 Yamaoka et al. ..... 271/145
6,485,011 B1 * 11/2002 Yen et al. ..... 271/10.03
6,736,389 B2 * 5/2004 Kosmoski ..... 271/116
6,747,429 B2 * 6/2004 Igarashi ..... 318/560

(Continued)

FOREIGN PATENT DOCUMENTS

JP A-57-67433 4/1982

(Continued)

*Primary Examiner*—Patrick Mackey
*Assistant Examiner*—Thomas Morrison
(74) *Attorney, Agent, or Firm*—Oliff & Berridge, PLC

(57) ABSTRACT

A sheet is firstly fed only by a sheet feed roller and then relayed to a transportation roller. When the transportation roller starts conveying the sheet, a motor coupled to the sheet feed roller is deenergized so that the sheet feed roller is not rotated by the power of motor but rotated due to frictional contact with the sheet being transported by the transportation roller. At this time, the rotation sensor senses rotations of a disk attached to the shaft of the sheet feed roller. A trailing edge of the sheet is detected when the rotation sensor no longer detects the rotations of the disk. Based on the detection of the trailing edge of the sheet, the timing at which the subsequent sheet is fed out by the sheet feed roller is determined. As such, an interval between successively fed two cut sheets can be shortened, thereby improving sheet feed efficiency.

14 Claims, 14 Drawing Sheets

U.S. PATENT DOCUMENTS

2002/0054381 A1 5/2002 Iwase

FOREIGN PATENT DOCUMENTS

| | | |
|---|---|---|
| JP | A 06-271145 | 9/1994 |
| JP | A 8-73062 | 3/1996 |
| JP | A 09-058903 | 3/1997 |
| JP | A 9-226957 | 9/1997 |
| JP | A 10-114445 | 5/1998 |
| JP | B2 2895158 | 3/1999 |
| JP | A 2000-284556 | 10/2000 |
| JP | A 2001-106346 | 4/2001 |
| JP | A 2002-60068 | 2/2002 |

* cited by examiner

SHEET FEED CONTROL
RECEPTION OF PRINT DATA
S301
START OF SF OPERATION
S302
LEADING EDGE DETECTED ?
S303
NO
YES
FEED SHEET
S304
START ST OPERATION AND STOP SF ROLLER
S305
DOES ST ROLLER MAKE FW ROTATIONS ?
S306
NO
DRIVER ST ROLLER TO MAKE FW ROTATIONS
S307
YES
START SENSING OPERATION WITH ROTATION SENSOR
S308
DISK STOPPED ?
S309
NO
YES
PRINT DATA FOR NEXT SHEET PRESENT ?
S310
YES
FEED SHEET
S311
NO
END

SHEET FEED DEVICE FOR FEEDING CUT SHEETS WHILE INTERPOSING SHORTENED INTERVAL BETWEEN SUCCESSIVE FED TWO SHEETS

BACKGROUND OF THE INVENTION

1. Field of the Invention

The present invention relates to a sheet feed device for feeding cut sheets one by one while separating the topmost sheet stacked in a paper cassette.

2. Description of the Related Art

A conventional sheet feed device as disclosed in Japanese Patent Publication No. 2895158 is schematically shown in FIG. 1. The device feeds cut sheets stacked in a paper cassette 206 to a print position and then discharges onto a discharge tray 211. A print head 201 performs printing on a sheet of paper fed to the print position. The print head 201 is mounted on a carriage 202 that is movably supported on a carriage shaft 203 extending in the widthwise direction of the sheet of paper.

The sheet feed device includes a sheet feed roller 207, a sheet feed motor (not shown), a transportation roller 204, a first pinch roller 205*a*, a second pinch roller 205*b*, an edge sensor 209, and a discharge roller 210 and its associated pinch roller 210*a*. The sheet feed roller 207 is disposed above the paper cassette 206. The transportation roller 204 is disposed downstream of the sheet feed roller 207 with respect to the direction in which the sheet of paper is fed. The first and second pinch rollers 205*a* and 205*b* are both urged against the transportation roller 204. The edge sensor 209 is disposed in the vicinity of the first pinch roller 205*a* and also in confrontation with the transportation roller 204. The discharge roller 210 is disposed between the print head 201 and the discharge tray 211.

In operation, the sheet feed motor is driven to rotate the sheet feed roller 207. Then, the sheet feed roller 207 feeds the topmost sheet stacked in the paper cassette 206 toward a nip between the first pinch roller 205*a* and the transportation roller 204. In cooperation with the first and second pinch rollers 205*a* and 205*b*, the transportation roller 204 feeds the sheet of paper fed by the sheet feed roller 207 to the print position. The edge sensor 209 senses the trailing edge of the sheet of paper transported along the transportation roller 204. After the print head 201 performs printing operations on the sheet of paper, the printed sheet is discharged onto the discharge tray 211 in accordance with rotations of the discharge roller 210 and the pinch roller 210*a*.

When the sheet of paper has reached the print position 208, the print head 201 performs printing operations while moving back and forth along the carriage shaft 203. Upon completion of one-way movement of the print head 201, judgement is made as to whether or not the trailing edge of the sheet of paper is sensed by the edge sensor 209. The printing operations are repeatedly performed until the trailing edge of the sheet of paper is sensed by the edge sensor 209. When the sheet of paper is printed for a predetermined length after the trailing edge of the sheet of paper is sensed by the edge sensor 209, a sheet feed operation for the subsequent sheet of paper is commenced even if the printing operations are continuing for the preceding sheet of paper.

In the conventional sheet feed device described above, a long interval exists between the two successively fed sheets because the edge sensor 209 is disposed apart from the paper cassette 206. Long sheet-to-sheet interval is disadvantageous in terms of sheet feed efficiency.

In order to shorten the sheet-to-sheet interval, it is conceivable to commence the sheet feed operation before the edge sensor senses the trailing edge of the preceding sheet of paper. In order to accomplish such a sheet feed operation, the timing at which the sheet feed operation is commenced has to be determined based on the estimated position of the trailing edge of the preceding sheet of paper. However, with such sheet feed operations, exact sheet-to-sheet interval is not assured. Moreover, paper jam is liable to occur if a different size of paper is mixed with the sheets of paper stacked in the paper cassette.

SUMMARY OF THE INVENTION

In view of the foregoing, it is an object of the invention to provide a sheet feed device that can successively feed sheets of paper while preserving exact and shortened sheet-to-sheet interval.

In order to achieve the above and other objects, there is provided a sheet feed device that includes a sheet accommodating unit, a sheet feed roller, a trailing edge detector, and a control unit. The sheet accommodating unit accommodates a plurality of cut sheets in a stacked condition. The sheet feed roller feeds a cut sheet accommodated in the sheet accommodating unit. The cut sheet has a leading edge and a trailing edge defined in relation to a sheet feed direction in which the cut sheet is fed by the sheet feed roller. The trailing edge detector detects the trailing edge of the cut sheet and outputs a detection signal indicative of the detection of the trailing edge. The control unit determines a timing at which a subsequent cut sheet is fed out by the sheet feed roller based on the detection signal.

According to another aspect of the invention, there is provided a sheet feed device that includes a sheet accommodating unit for accommodating a plurality of cut sheets in a stacked condition, a first roller, a trailing edge detector, a second roller, and a control unit. The first roller feeds a cut sheet accommodated in the sheet accommodating unit. The trailing edge detector detects the trailing edge of the cut sheet and outputs a detection signal indicative of the detection of the trailing edge. The second roller is disposed downstream of the first roller with respect to the sheet feed direction, and starts conveying the cut sheet when the first roller stops feeding the cut sheet. The trailing edge detector starts detecting the trailing edge of the cut sheet when the first roller stops feeding the cut sheet. The control unit determines a timing at which a subsequent cut sheet is fed out by the first roller based on the detection signal.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
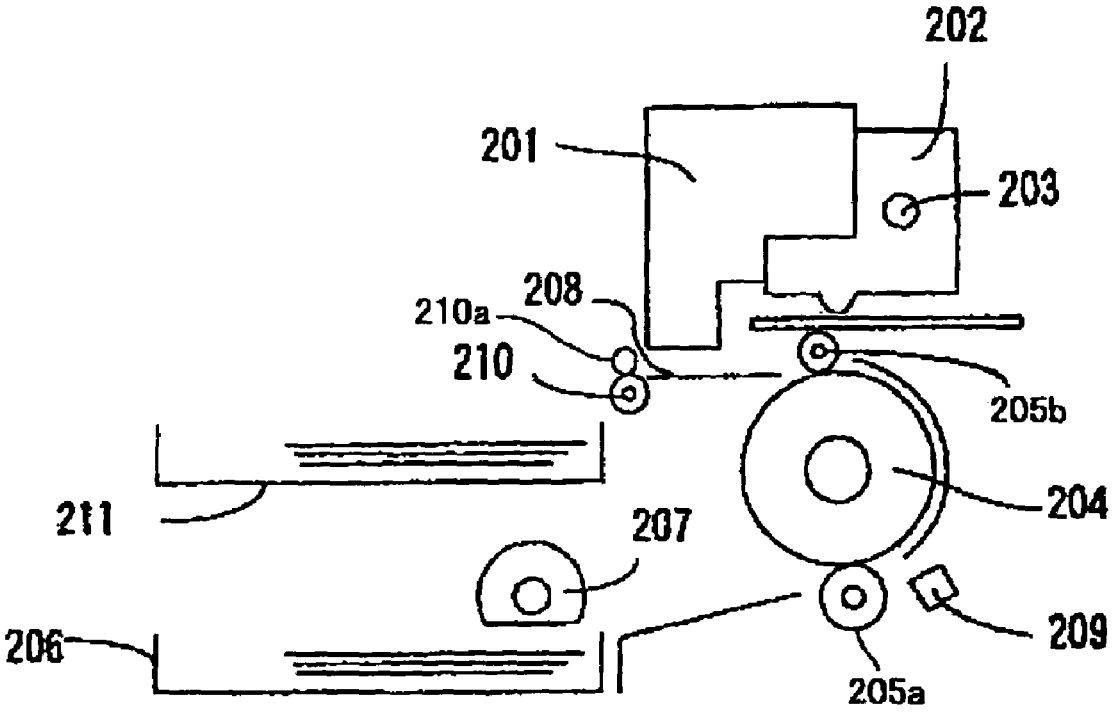
FIG.1 PRIOR ART
FIG. 1 is a schematic diagram showing a conventional sheet feed device.
Figure 2:
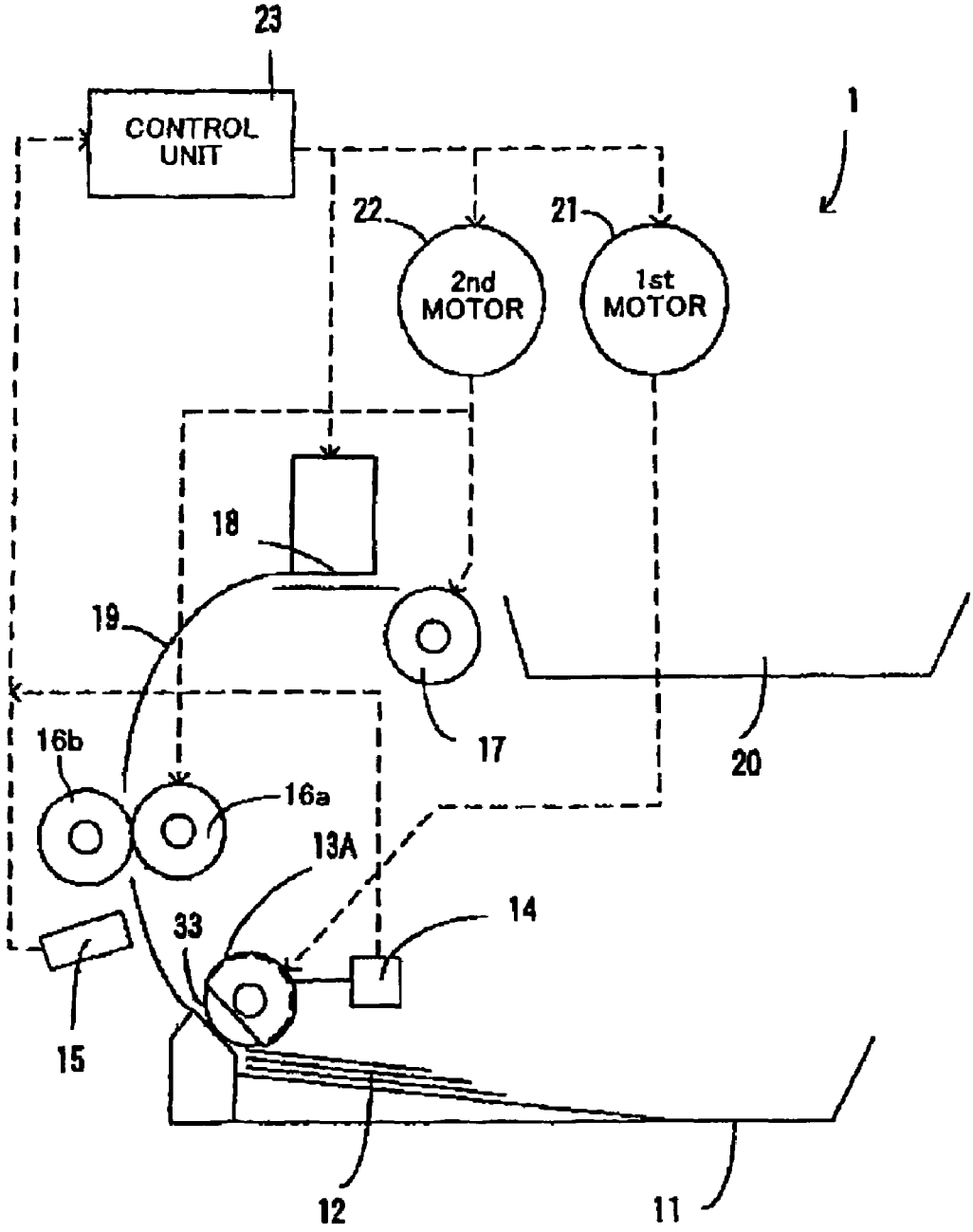
FIG. 2 is a schematic diagram showing a sheet feed device in accordance with a first embodiment of the invention.

A sheet feed device in accordance with a first embodiment of the invention will be described with reference to FIGS. 2 through 5. As shown in FIG. 2, a paper cassette 11 is disposed in the lowest part of the sheet feed device and sustains sheets of paper 12 in a stacked condition. A sheet feed roller 13A is in the form of a sector roller configured to have a D-shaped cross-section. The circular arc portion of the sheet feed roller 13A is brought into contact with the topmost sheet of paper stacked in the paper cassette 11. A pair of collars 33 is rotatably disposed at both sides of the sheet feed roller 13A to press the stacked sheets of paper so as not to be displaced. A rotation sensor 14 is disposed near one of the collars 33 to detect rotations of the collar 33. A registration sensor 15 is disposed downstream of the paper cassette 11 to detect the leading edge of a sheet of paper 12. A transportation roller 16*a* and its associated pinch roller 16*b* are disposed downstream of the registration sensor 15 to transport the sheet of paper 2 toward a print head 18. A guide 19 is disposed between the transportation roller 16*a* and the print head 18 to guide the sheet of paper 12 so that it moves along a predetermined transportation path. The print head 18 performs printing operations onto the sheet of paper 12. A discharge roller 17 is disposed downstream of the print head 12 to discharge the printed sheet of paper 12 onto a discharge tray 20.

A first motor 21 is provided for driving the sheet feed roller 13A. A second motor 22 is provided for driving the transportation roller 16*a* and the discharge roller 17. A control unit 23 controls the first and second motors 21, 22, and the print head 18.

Figure 3A:
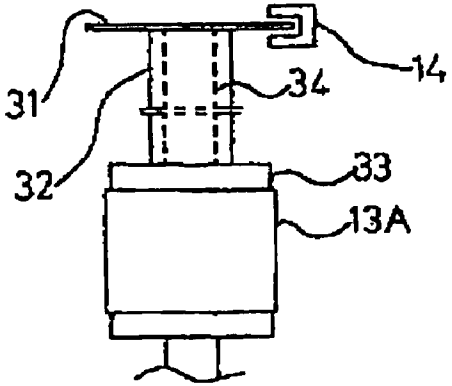
FIG. 3A is a top view showing a sheet feed roller and it associated components in accordance with the first embodiment of the invention.
Figure 3B:
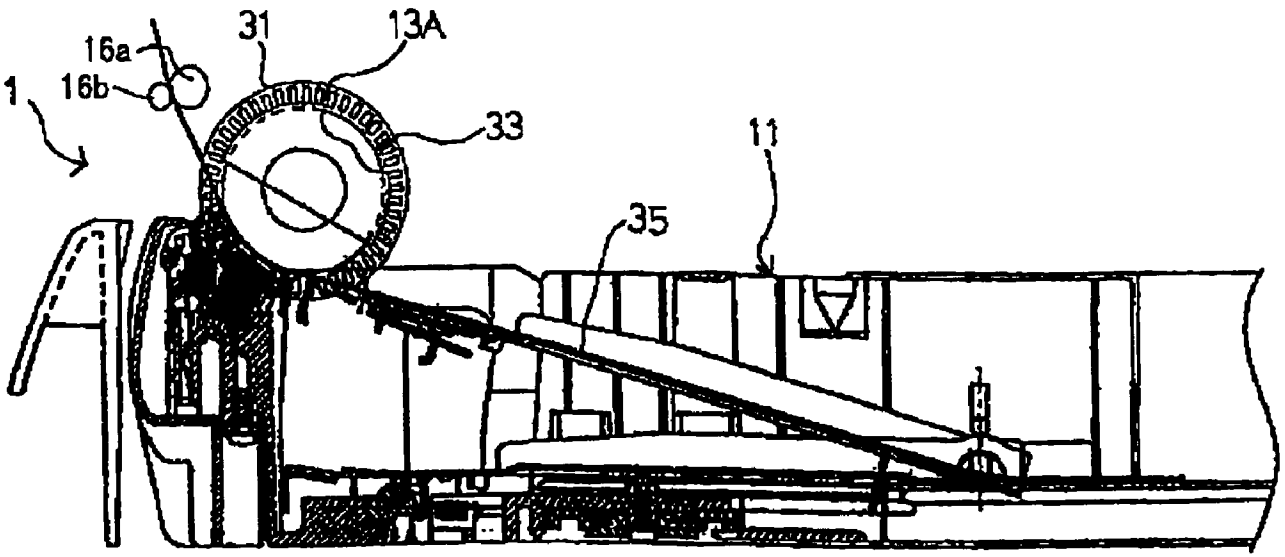
FIG. 3B is a cross-sectional side view showing the sheet feed roller feeding a sheet of paper in a paper cassette in accordance with the first embodiment.

Referring next to FIGS. 3A and 3B, a structure of the rotation sensor 14 and its linking components will be described. FIG. 3A is a top view and FIG. 3B is a cross-sectional side view.

As shown in FIG. 3B, the paper cassette 11 is provided with a sheet pressing plate 35 on which sheets of paper are placed. The sheet pressing plate 35 urges the sheets of paper stacked thereon upward so that the collars 33 are in pressing contact with the topmost sheet. More specifically, the collars 33 are in the form of a roller and disposed coaxially with the sheet feed roller 13A. The sheet feed roller 13A is fixedly secured to a roller shaft 34 so as to be rotated therewith. The collar 33 disposed at the side of the disk 31 is fixedly secured to a disk shaft 32 provided in coaxial relation with the roller shaft 34. Another collar is loosely supported on the roller shaft 34. The disk shaft 32 is freely rotatable with respect to the roller shaft 34. The collars 33 have a diameter slightly smaller than that of the circular arc portion of the sheet feed roller 13A. The disk 31 is fixedly secured to the disk shaft 32 to be rotatable therewith.

When the sheet feed roller 13A rotates, the circular arc portion of the sheet feed roller 13A is brought into contact with the topmost sheet and at this time the collars 33 are out of contact with the topmost sheet. When the sheet feed roller 13A further rotates and the circular arc portion is brought out of contact with the topmost sheet, the collars 33 are brought into contact with the topmost sheet. While the sheet feed roller 13A is being rotated with the shaft 34, the collars 33 are not rotated with the shaft 34.

As shown in FIG. 3B, the disk 31 is formed with equi-pitch slits at its periphery and the rotation sensor 14 is disposed to sense the rotations of the disk 31. More specifically, the rotation sensor 14 includes, for example, a light emitting element and a light receiving element. These two elements are disposed in confronting relation with each other with the peripheral portion of the disk 31 interposed therebetween. An encoder is configured by the disk 31 and the rotation sensor 14.

Figure 4:
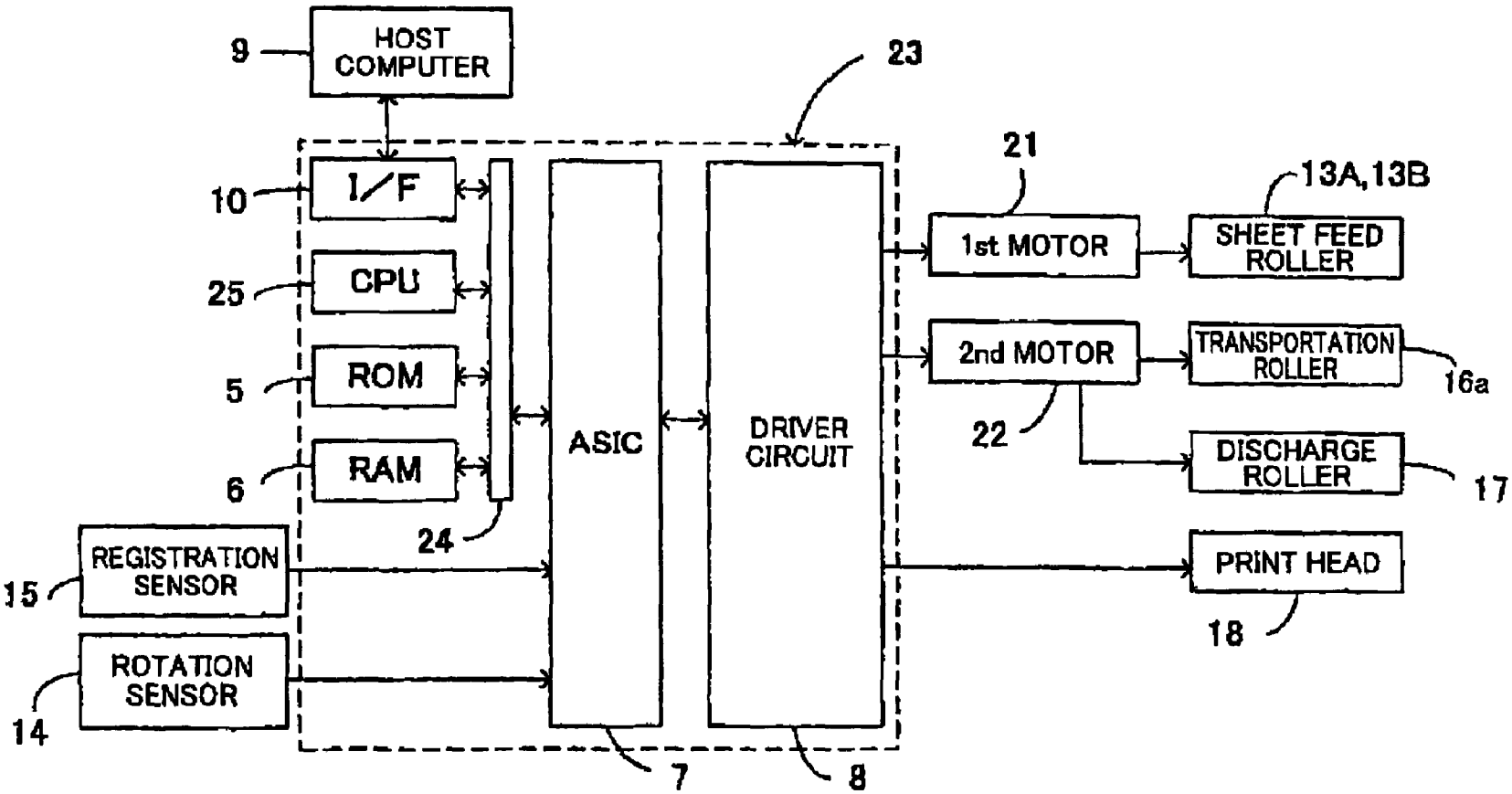
FIG. 4 is a block diagram showing a control unit and components connected thereto in accordance with first to third embodiments of the invention.

Next, referring to FIG. 4, the control unit 23 will be described. The control unit 23 implements image forming process based on print data received from a host computer 9 through an interface (I/F) 10, and also governs the first and second motors 21, 22 and the print head 18. The control unit 23 includes a microcomputer made up of CPU 25, ROM 5, RAM 6, and internal bus 24. The control unit 23 further includes an ASIC (Application Specific Integrated Circuit) 7 and a driver circuit 8 connected to the ASIC 7.

The CPU 25 temporarily stores the print data fed from the host computer 9 into the RAM 6 and implements conversion process to convert the print data into image signal in accordance with a program stored in the ROM 5. The image signal thus converted is supplied to the ASIC 7. The ASIC 7 activates the driver circuit 8 based on the outputs supplied from a registration sensor 15 and the rotation sensor 14. The registration sensor 15 senses the leading edge and rotation sensor 14 senses the trailing edge of the sheet of paper being transported. The driver circuit 23 supplies driving signals to the first and second motors 21, 22 and also to the print head 18 together with the image signal. The sheet feed roller 13A, the transportation roller 16*a*, the discharge roller 17 and the print head 18 are controlled to form images on the sheet of paper being transported.

Figure 5:
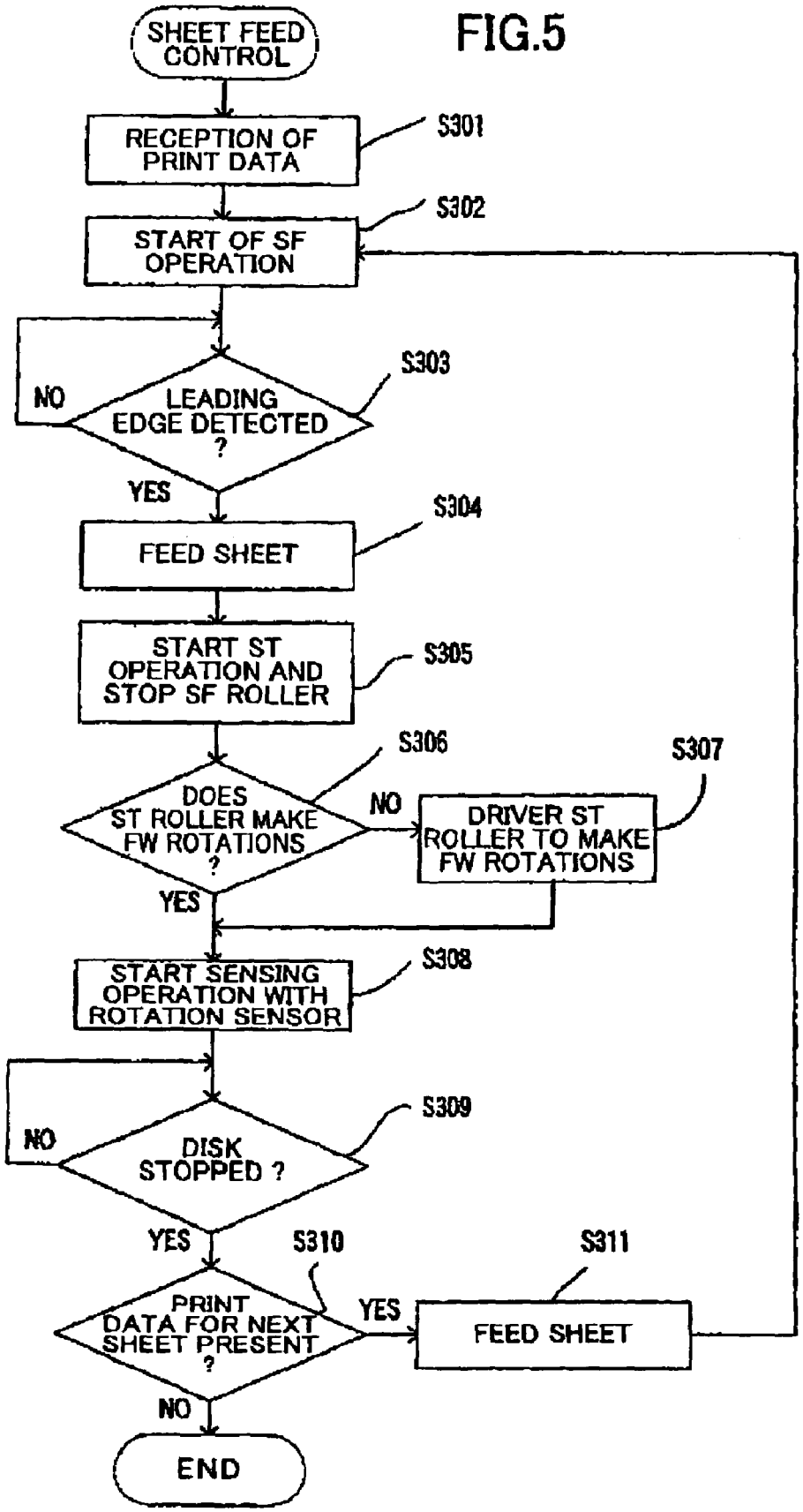
FIG. 5 is a flowchart showing operational sequence of the sheet feed operation performed by the control unit in accordance with the first to third embodiments of the invention.

Sheet feed operation will next be described while referring to the flowchart shown in FIG. 5.

When the control unit 23 receives the print data from the host computer 9 (S301), sheet feed (SF) operation is started (S302) In the sheet feed operation, the driver circuit B supplies the drive signal to the first motor 21 to rotate the same. In accordance with rotations of the first motor 21, the sheet feed roller 13A makes one rotation to feed out the topmost sheet stacked in the paper cassette 11. Then, determination is made as to whether or not the registration sensor 15 senses the leading edge of the sheet 12 (S303). When the leading edge of the sheet 12 is sensed by the registration sensor 15 (S303: YES), the sheet feed roller 13A further makes one rotation to feed the sheet 12 a predetermined distance (S304).

The length of the circular arc portion of the sheet feed roller 13A is set to be approximately equal to the predetermined distance mentioned above. When the sheet 12 is fed out from the paper cassette 11 by the sheet feed roller 13A, the transportation roller 16*a* and the pinch roller 16*b* are rotating in reverse or stopped so as not allow the sheet 12 to pass the nip between the two rollers, As a result, the sheet 12 that is brought into abutment with the nip portion between the transportation roller 16*a* and the pinch roller 16*b* is slightly bent, thereby preventing obliquely feeding the sheet 12. In this embodiment, this oblique-feed prevention operation is performed for only the firstly fed sheet but not performed for the rest of sheets subsequently fed. However, the oblique-feed prevention operation may be formed for all the sheets to prevent occurrence of the oblique feeding throughout the printing operation.

Next, the routine proceeds to S305 where sheet transportation (ST) operation is started. Upon start of the sheet transportation operation, the first motor 21 is stopped. In S306, determination is made as to whether or not the transportation roller 16*a* is forwardly rotating, i.e., in the direction in which the sheet 12 is fed toward the print head 18. When the transportation roller 16*a* is forwardly rotating (S306: YES), the sheet 12 is further fed by the transportation roller 16*a* and the pinch roller 16*b*. Then, the routine proceeds to S308. On the other hand, when the transportation roller 16*a* is not forwardly rotating (S306: NO), then the routine proceeds to S307 where the driver circuit 6 drives the second motor 22 to rotate forwardly. The second motor 22 rotates the transportation roller 16*a* and the discharge roller 17 so that the sheet 12 that is in abutment with the nip portion between the transportation roller 16*a* and the pinch roller 16*b* is transported toward the print head 18 and then discharged onto the discharge tray 20. In this manner, the sheet transportation operation is performed by the transportation roller 16*a* and the discharge roller 17 after the sheet 12 is relayed to the transportation roller 16*a* by the sheet feed roller 13A.

When the first motor 21 stops and the sheet transportation operation is started, the rotation sensor 14 starts sensing rotations of the disk 31 (S308). The rotation sensor 14 continuously senses the rotations of the disk 31 until the disk 31 stops its rotations (S309). The fact that the disk 31 is stopped (S309: YES) indicates that the trailing edge of the sheet of paper 12 is sensed. The disk 31 stops its rotation when the collars 33 are out of frictional contact with the topmost sheet.

When the trailing edge of the sheet 12 is detected in S309, the routine proceeds to S310 where the control unit 23 determines whether or not there is further print data to be printed on the subsequent sheet of paper 12. When there is no print data, the driving of the second motor 22 is stopped and the routine is hereby ended upon completion of printing on the sheet 12 currently being subject to printing and discharging the printed sheet 12 onto the discharge tray 20 by means of the discharge roller 17. On the other hand, when there remains print data outstanding for further printing on the subsequent sheet of paper, the routine proceeds to S311 where the sheet 12 subject to printing is fed by a prescribed distance so that a proper distance can be interposed between the trailing edge of the current sheet of paper and the leading edge of the subsequent sheet of paper. Then, the routine returns to S302 where sheet teed operation for the subsequent sheet is started.

As described above, the collars 33 are freely rotatable about the rotational shaft of the sheet feed roller 13A. When the circular arc portion of the sheet feed roller 13A is out of contact with the sheet 12, the collars 33 rotate while frictionally contacting the sheet 12. When the collars 33 are out of contact with the topmost sheet 12, the collars 33 stop rotating. Accordingly, detection of the trailing edge of the sheet 12 can be made based on stoppage of rotations of the collars 33.

The trailing edge of the sheet 12 can be detected substantially simultaneously with a time when the sheet 12 is completely fed out from the paper cassette 11 by the sector roller 13A. Therefore, the interval between the two successively fed cut sheets can be set to a fixed and shortened distance and so the sheet feeding efficiency is improved. Further, detection of the trailing edge of the sheet is performed for each sheet, therefore, the interval between the two successively fed cut sheets can be set to a fixed and shortened distance even if there are variations in length of the sheet. Moreover, with the use of the rotation sensor 14 and other sensor, such as a position sensor, detection of paper jam can be performed.

A sheet feed device according to a second embodiment of the invention will next be described. The sheet feed device 2 of the second embodiment is similar to the sheet feed device 1 of the first embodiment in arrangement but is different therefrom in the shape of the sheet feed roller and also in the structure of the rotation sensor. The same components as those of the first embodiment will be denoted by the same reference numerals and the description thereof will be omitted to avoid duplicate description.

Figure 6:
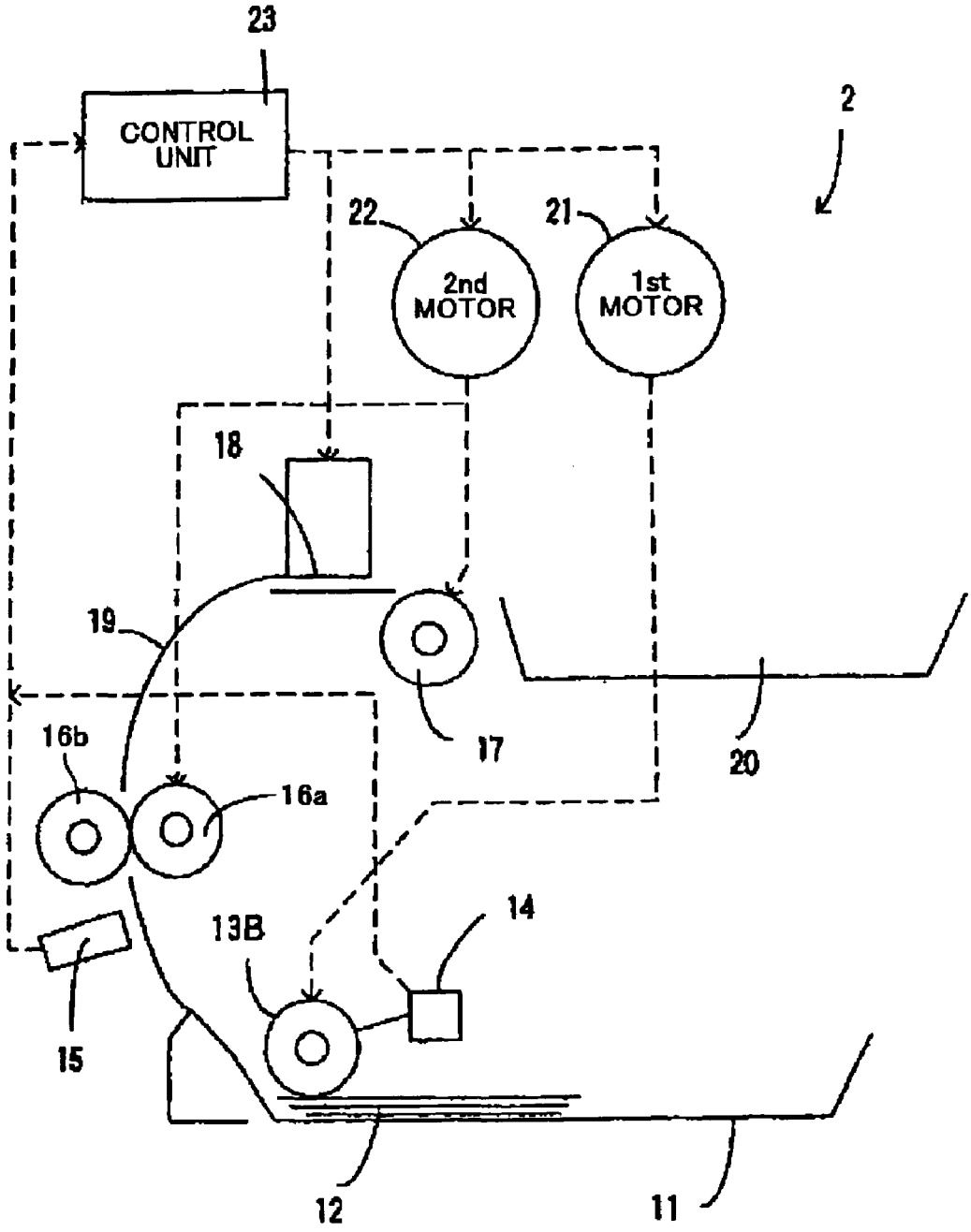
FIG. 6 is a schematic diagram showing a sheet feed device in accordance with a second embodiment of the invention.

As shown in FIG. 6, the sheet feed roller 13B has a circular cross-section and is disposed to contact the topmost sheet 12 stacked in the paper cassette 11 at all times. The collars that are provided in the sheet feed device 1 of the first embodiment are not necessary for the device 2 of the second embodiment because the sheet feed roller 13B functions to urge the sheets of papers 12 downward. A rotation sensor 14 senses rotations of the sheet feed roller 13B. When the sheet feed roller 13B stops its rotation, it is assumed that the trailing edge of the sheet 12 is sensed.

Figure 7A:
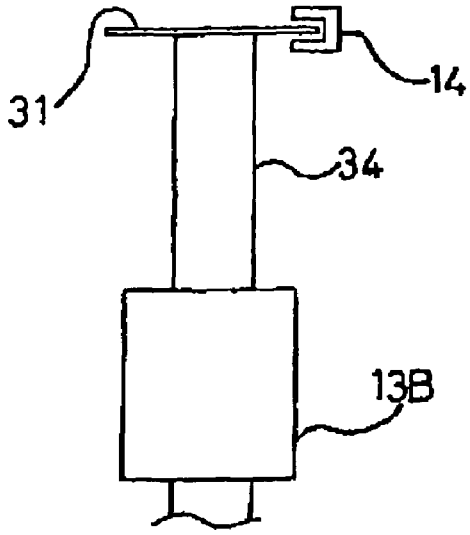
FIG. 7A is a top view showing a sheet feed roller and it associated components in accordance with the second embodiment of the invention.
Figure 7B:
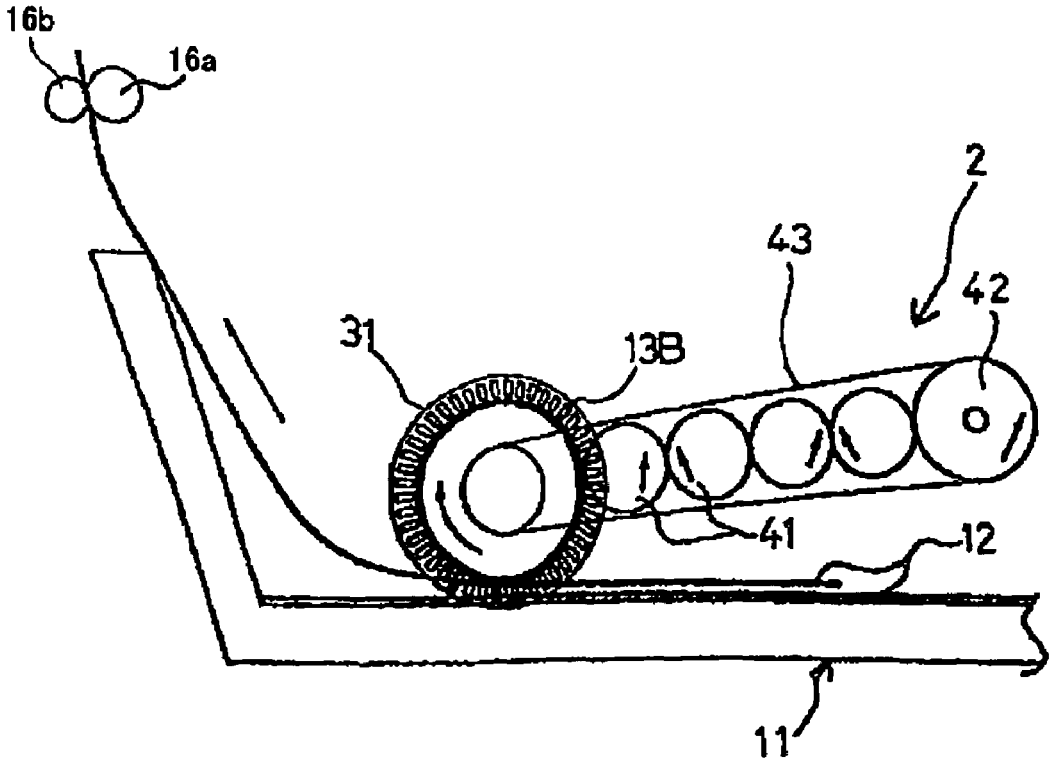
FIG. 7B is a cross-sectional side view showing the sheet feed roller feeding a sheet of paper in a paper cassette in accordance with the second embodiment.

Next, the components in association with the rotation sensor 14 will be described while referring to FIGS. 7A and 7B wherein FIG. 7A is a top view and FIG. 7B is a cross-sectional view. The sheet feed roller 13B is rotatably supported on an arm 43. The arm 43 includes a gear train consisting of a drive gear 42 and a plurality of idle gears (four in the illustrated example). Rotations of the drive gear 42 are transmitted through the idle gears 41 to the sheet feed roller 13B. The arm 43 is pivotally movable about the shaft of the drive roller 42 so that the sheet feed roller 13B moves toward and away from the paper cassette 11.

As shown in FIG. 7A, the sheet feed roller 13B is fixedly supported on a rotational shaft 34 and is rotatable therewith A disk 31 is fixedly and coaxially attached to one end of the rotational shaft 34 so as to rotate with the sheet feed roller 13B. A rotation sensor 14 and the disk 31 serve as an encoder.

Referring again to the flowchart shown in FIG. 5, the sheet feed operation performed by the control unit 23 will be described. The operation of the sheet feed device 2 is the same as that of the sheet feed device 1 in accordance with the first embodiment except for S305 through S308. Accordingly, only S305 through S308 will be described.

When the sheet 12 is relayed to the transportation roller 16*a*, a sheet transportation (ST) operation is started (S305). The sheet feed (SF) roller 13B stops rotating after it feeds the sheet 12 a prescribed distance. In S306, determination is made as to whether or not the transportation roller 16*a* is forwardly rotating, i.e., in the direction in which the sheet 12 is fed toward the print head 18. When the transportation roller 16*a* is forwardly rotating (S306: YES), the sheet 12 is further fed by the transportation roller 16*a* and the pinch roller 16*b*. Then, the routine proceeds to S308. On the other hand, when the transportation roller 16*a* is not forwardly rotating (S306: NO), then the routine proceeds to S307 where the driver circuit 8 drives the second motor 22 to rotate forwardly. The second motor 22 rotates the transportation roller 16*a* and the discharge roller 17 so that the sheet 12 that is in abutment with the nip portion between the transportation roller 16*a* and the pinch roller 1*b* is transported toward the print head 18 and then discharged onto the discharge tray 20. In this manner, the sheet transportation operation is performed by the transportation roller 11*a* and the discharge roller 17.

After the first motor 21 stops its rotation, the sheet feed roller 13B is not rotated by the first motor 21 but rotated due to the frictional contact with the topmost sheet 12 being transported by the transportation roller 16*a*. In S308, the rotation sensor 14 starts sensing the rotations of the disk 31. Similar to the operations of the sheet feed device 1 of the first embodiment, the rotation sensor 14 keeps on sensing rotations of the disk 31 until the disk 31 stops its rotations. When the rotations of the disk 31 are stopped, the control unit 23 determines that the trailing edge of the topmost sheet 12 has reached to the position of the sheet feed roller 13B. The sheet feed amount in S311 is determined while taking in account a distance between the leading edge of the sheet 12 and the contact point of the sheet feed roller 13B with the sheet 12 because in the second embodiment, the sheet feed roller 13B stays on the stack of sheets 12, not on the leading edge of the sheet.

As described above, after the sheet feed roller 13B feeds the sheet 12 with its own rotational power, the sheet feed roller 13B is rotated due to frictional contact with the sheet 12 that is transported by the transportation roller 16*a*. The sheet feed roller 13B stops its rotation when the sheet 12 is completely fed out from the paper cassette 11. Accordingly, detection of the trailing edge of the sheet 12 can be made based on stoppage of rotations of the sheet feed roller 13B.

As such, the trailing edge of the sheet 12 can be detected substantially simultaneously with a time when the sheet 12 is completely fed out from the paper cassette 11. Because of the simultaneous detection of the trailing edge of the sheet 12, the interval between the two successively fed cut sheets can be set to a fixed and shortened distance and so the sheet feeding efficiency is improved. Further, detection of the trailing edge of the sheet 12 is performed for each sheet, therefore, the interval between the two successively fed cut sheets can be set to a fixed and shortened distance even if there are variations in length of the sheet. Moreover, with the use of the rotation sensor 14 and other sensor, such as a position sensor, detection of paper jam can be performed.

Figure 8A:
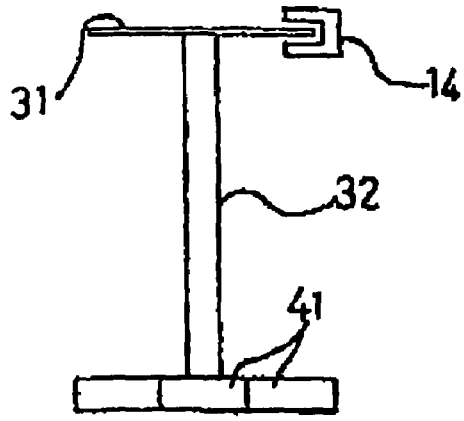
FIG. 8A is a top view showing a sheet feed roller and it associated components in accordance with one modification of the second embodiment.
Figure 8B:
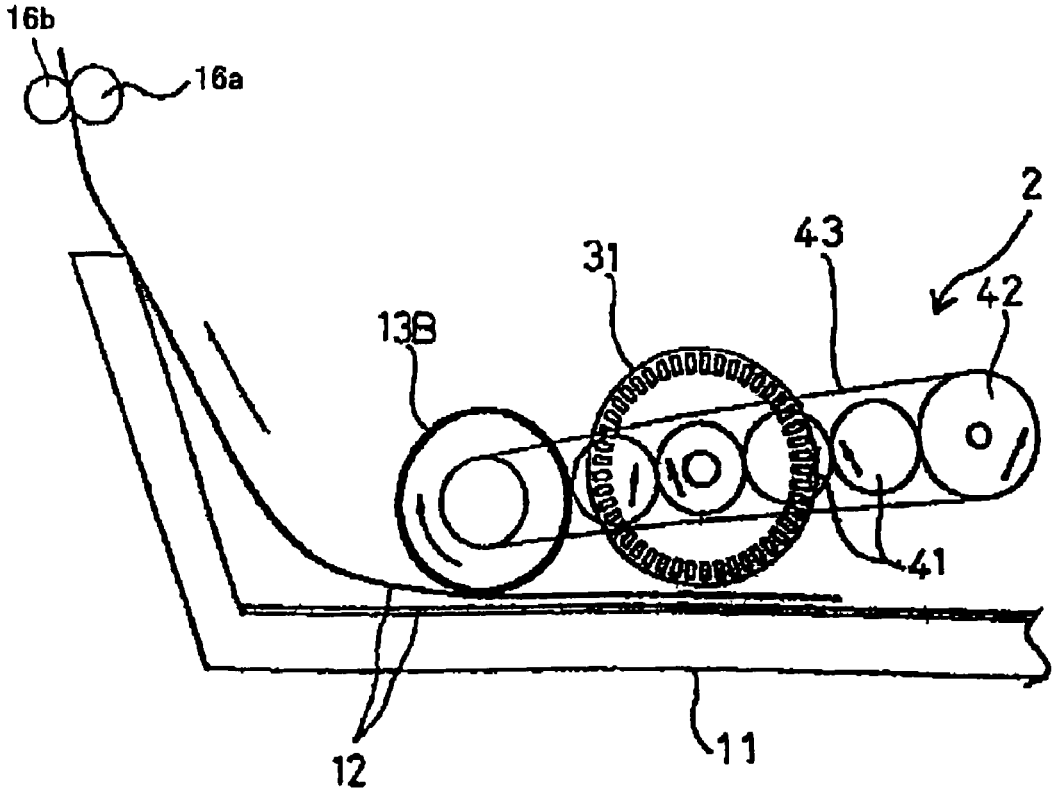
FIG. 8B is a cross-sectional side view showing the sheet feed roller feeding a sheet of paper in a paper cassette in accordance with the modification of the second embodiment.

With the sheet feed device 2 in accordance with the second embodiment, the rotations of the sheet feed roller 13B are directly sensed by the encoder configured by the disk 31 and the rotation sensor 14. This can be modified as shown in FIGS. 8A and 8B wherein the disk 32 is coaxially attached to the shaft 32 of an idle gear 41 interposed between the drive gear 42 and the sheet feed roller 13B. Rotations of the idle gear 41 sensed according to this arrangement indirectly indicate the rotations of the sheet feed roller 13B.

Figure 9A:
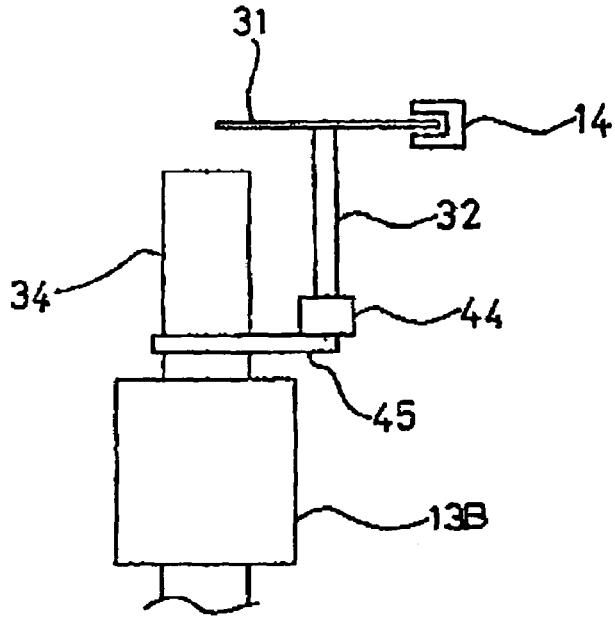
FIG. 9A is a top view showing a sheet feed roller and it associated components in accordance with another modification of the second embodiment.
Figure 9B:
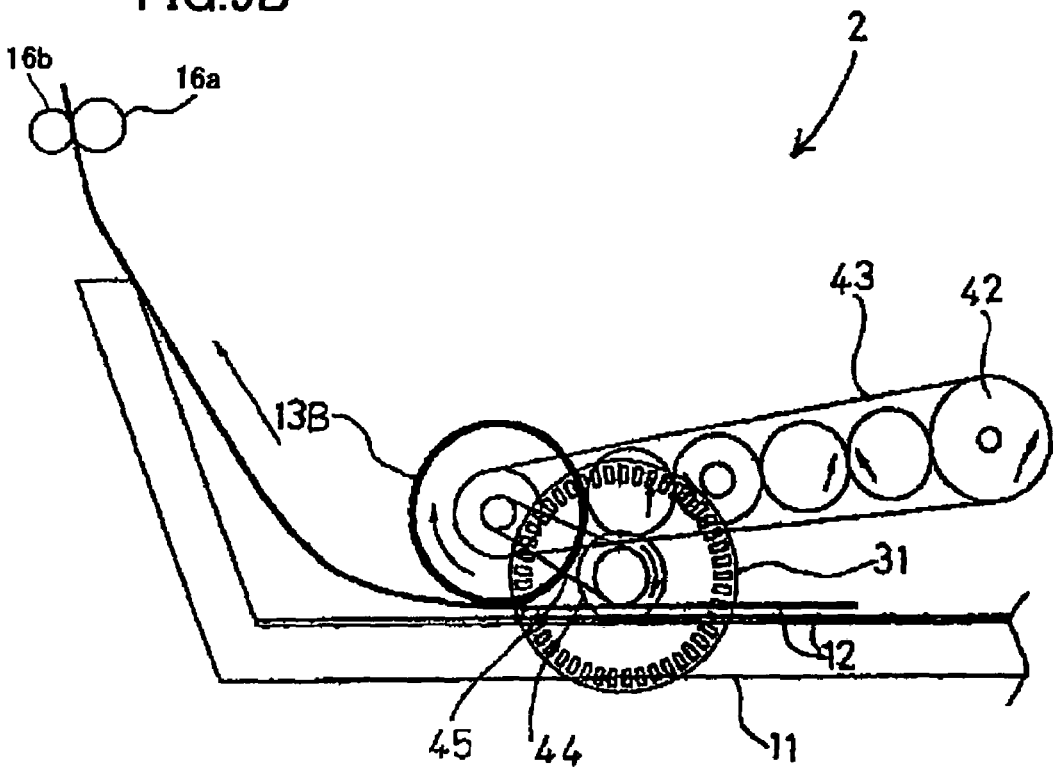
FIG. 9B is a cross-sectional side view showing the sheet feed roller feeding a sheet of paper in a paper cassette in accordance with the modification in FIG. 9A.

Further modification of the second embodiment is shown in FIGS. 9A and 9B wherein a disk supporting plate 45 is attached to the rotational shaft 34 of the sheet feed roller 13D, and a roller 44 is rotatably supported on the disk supporting plate 45. The roller 44 is held in contact with the topmost sheet in the paper cassette 11. The disk 31 is attached to one end of a shaft 32 and the roller 44 is attached to another end of the shaft 32 so that the disk 31 rotates with the roller 44. Rotations of the roller 44 are sensed by the encoder configured by the disk 31 and the rotation sensor 14.

With the arrangement shown in FIGS. 9A and 9B, the trailing edge of the sheet 12 can be detected before it is completely fed out from the paper cassette 11. Therefore, when the sheets of paper 12 are successively fed out one after another, the sheet 12 can be fed without delay. As a result, the interval between the two successively fed cut sheets can be shortened. With this modification, the sheet feed amount in S311 of the flowchart of FIG. 5 is determined while taking in account a distance between the leading edge of the sheet 12 stacked in the paper tray 11 and the contact point of the roller 44 with the sheet 12.

The sheet feed roller 13B of the sheet feed device in accordance with the second embodiment is swingably movable toward and away from the paper cassette 11. The second embodiment can further be modified to urge a stack of sheets 12 toward the sheet feed roller 13B with the provision of sheet pressing plate 35 in the bottom of the paper cassette 11 as in the first embodiment. With such a modification, the trailing edge of the sheet 12 can be detected substantially simultaneously with a time when the sheet 12 is completely fed out from the paper cassette 11 without need for moving the sheet feed roller 13B toward and away from the paper cassette 11. Therefore, the interval between the two successively fed cut sheets can be set to a fixed and shortened distance and so the sheet feeding efficiency is improved.

Figure 10:
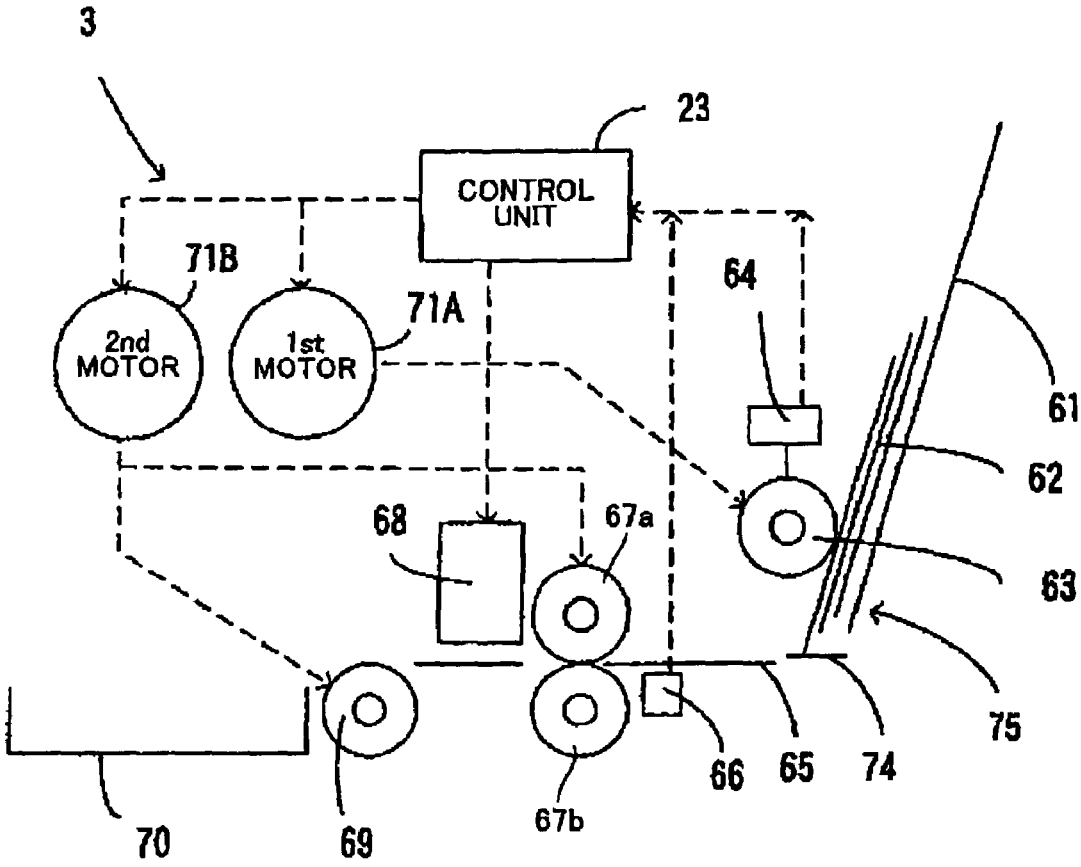
FIG. 10 is a schematic diagram showing a sheet feed device in accordance with the third embodiment of the invention.

A sheet feed device 3 according to a third embodiment of the invention will be described while referring to FIGS. 10, 11A and 11B. The sheet feed device 3 includes a paper storage 75 that sustains a stack of sheets 62 in a slanted state. The paper storage 75 is formed of a slanted wall 61 and a bottom wall 75. The slanted wall 61 is slanted with respect to the vertical direction and supports the stack of sheets 12 wherein the lowermost sheet is in contact with the slanted wall 61. The bottom wall 75 also supports the stack of sheets 12 wherein the lower sides of the stack of sheets 62 are in contact with the bottom wall 75.

A sheet feed roller 63 has a circular cross-section and is disposed to contact the topmost sheet 12 held in the paper storage 75. A rotation sensor 64 is provided in conjunction with the sheet feed roller 63 to detect rotations of the sheet feed roller 63. The registration sensor 66 is disposed downstream of the paper storage 75 to sense the leading edge of the sheet 62 fed out by the sheet feed roller 63. A transportation roller 67*a* and a pinch roller 67*b* are disposed downstream of the registration sensor 66 to transport the sheet 62 relayed by the sheet feed roller 63. A guide 65 is provided for guiding the sheet 62 along a prescribed path. A print head 68 is disposed downstream of the transportation roller 67*a* for printing on the sheet 62 transported by the sheet feed roller 67*a* and the pinch roller 67*b*. A discharge roller 69 is disposed downstream of the print head 68 for discharging a printed sheet onto a discharge tray 70.

The sheet feed device 3 also includes a first motor 71A and a second motor 71B. The first motor 71A is operatively coupled to the sheet feed roller 63 to rotate the latter. The second motor is operatively coupled to the transportation roller 67*a* and the discharge roller 69 to rotate these two rollers. The sheet feed device 3 further includes a control unit 23 for controlling the first and second motors 71A and 71B, the rotation sensor 64, and the print head 68.

Figure 11A:
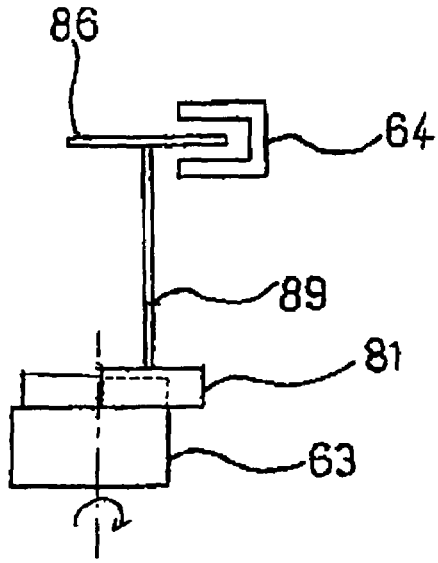
FIG. 11A is a top view showing a sheet feed roller and it associated components in accordance with the third and fourth embodiments of the invention.
Figure 11B:
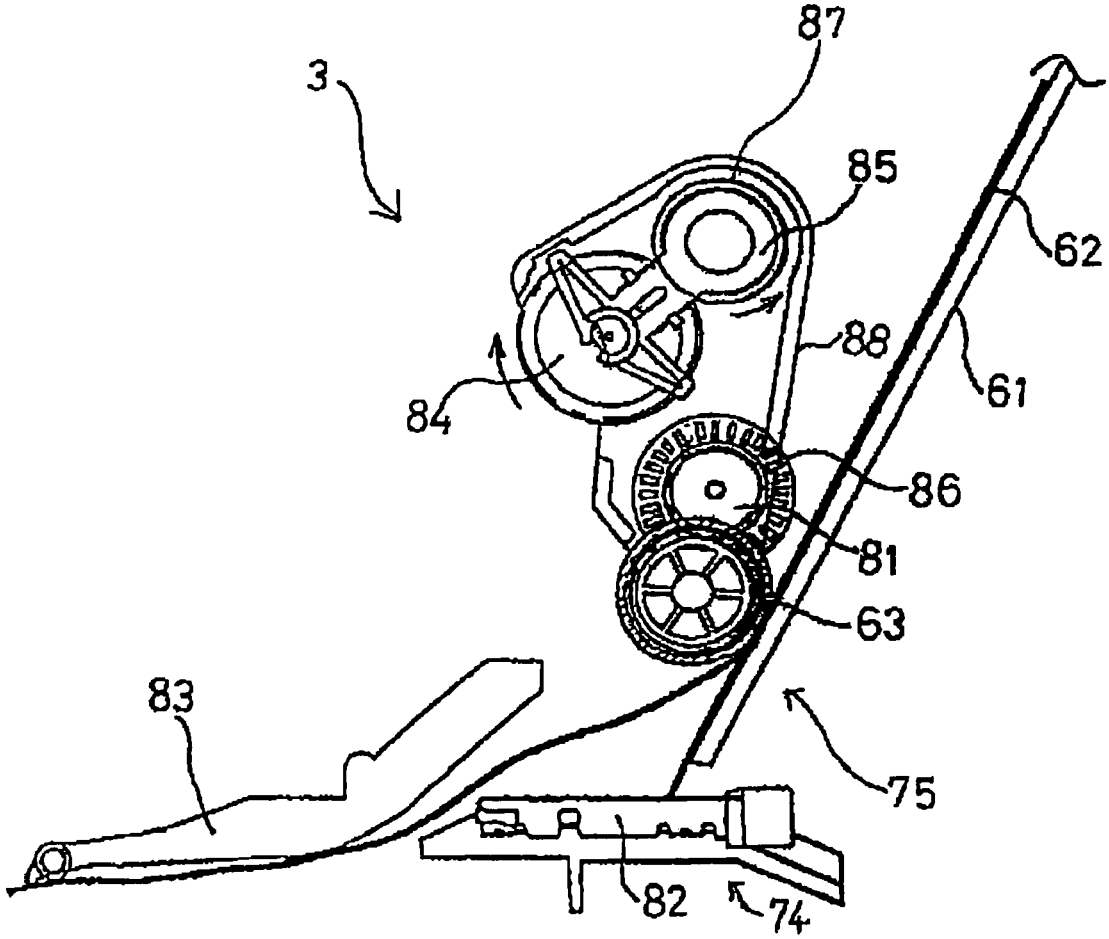
FIG. 11B is a cross-sectional side view showing the sheet feed roller feeding a sheet of paper in a paper cassette in accordance with the third and fourth embodiments.

Next, the components in association with the rotation sensor 64 will be described while referring to FIGS. 11A and 11B wherein FIG. 11A is a top view and FIG. 11B is a cross-sectional view, As shown in FIG. 11A, the sheet feed roller 63 is in meshing engagement with an idle gear 81 as will be described later. A disk shaft 89 has one end coaxially attached to the idle gear 81 and another end coaxially attached to a disk 86. An encoder is formed of the disk 86 and the rotation sensor 64. As shown in FIG. 11B, the bottom wall 74 of the paper storage 75 is provided with a sheet separator 82 with which the lower sides of the stack of sheets are contacted.

The first motor 71A is directly coupled to a drive gear 87 to rotate the same. To transmit the rotations of the drive gear 85 to the sheet feed roller 63, an intermediate gear 84 and an idle gear 81 are provided. The drive gear 87 and the intermediate gear 84 are rotatably supported on a gear support 85 and meshingly engaged with each other. The intermediate gear 84 is movable toward the idle gear 81 and brought into meshing engagement with the idle gear 81. The sheet feed roller 63 is rotatably supported on a roller support 88 and has a gear portion that is meshingly engaged with the idle gear 81. The roller support 88 is rotatable about the shaft of the drive gear 87. The sheet feed roller 63 is movable toward and away from the slanted wall 61 so that it can contact the topmost sheet 62 held in the paper storage 75.

In operation, when the sheet feed operation is started, the first motor 71A is driven to rotate the drive gear 87. In accordance with rotations of the drive gear 87, the intermediate gear 87 is rotated and moves toward the idle gear 81. When the intermediate gear 84 is brought into meshing engagement with the idle gear 81, the rotations of the intermediate gear 84 are transmitted to the sheet feed roller 63 to rotate the latter. At this time, the sheet feed roller 63 is held in a condition in which the roller 63 is in contact with the topmost sheet 62. Accordingly, the topmost sheet 62 is fed out by the sheet feed roller 63 while being separated from the remaining sheets of paper with the aid of the sheet separator 82. When the sheet 62 is fed out with the sheet feed roller 63, the transportation roller 67*a* is being rotated in reverse so as not to allow the sheet 62 to pass through the nip between the transportation roller 67*a* and the idle roller 67*b*, thereby preventing the sheet 62 from being obliquely fed.

The first motor 71A is deenergized to stop rotations of the sheet feed roller 63 and the idle gear 81, and the transportation roller 67*a* and the discharge roller 69 are driven by the second motor 71B. The sheet feed roller 63 and the idle gear 81 are disconnected from the first motor 71A and so held in a freely rotatable condition. However, the moving sheet 62 causes the sheet feed roller 63 and the idle gear 81 to rotate.

In accordance with rotations of the idle gear 81, the disk 86 rotates and the rotation sensor 64 senses the rotations of the disk 86. The control unit 23 receives the output from the rotation sensor 64 and determines the trailing edge of the sheet 62. The structure of the control unit 23 is identical to that shown in FIG. 4, so the description of the control unit 23 is omitted herein to avoid duplicate description. Also, the sheet feeding operation performed by the control unit 23 is similar to that described with respect to the sheet feed device 2 in accordance with the second embodiment, no further description is necessary.

With the rotation sensor 64 thus constructed, the trailing edge of the sheet 62 can be detected before it is completely fed out from the paper cassette 61. Therefore, when the sheets of paper 62 are successively fed out one after another, the trailing edge of the sheet 62 can be detected before it is completely fed out from the paper storage 75. As a result, the interval between the two successively fed cut sheets can be shortened while maintaining the interval at constant. Moreover, a paper jam can be detected if the rotation sensor 64 is used in conjunction with a position sensor or the like.

Figure 12:
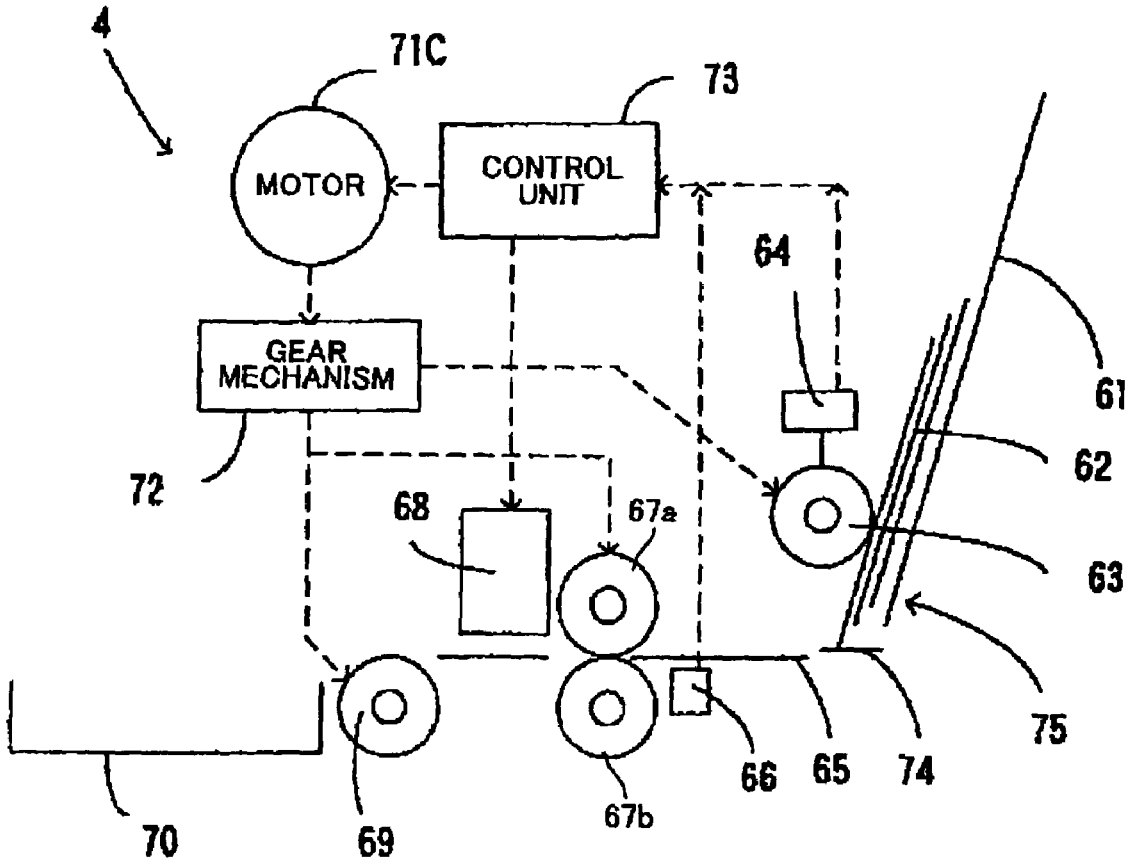
FIG. 12 is a schematic diagram showing a sheet feed device in accordance with the fourth embodiment of the invention.

A sheet feed device 4 in accordance with a fourth embodiment of the invention will be described while referring to FIG. 12. The sheet feed device 4 of the fourth embodiment is similar to the sheet feed device 3 of the third embodiment in arrangement but is different therefrom in that a single motor is employed, in contrast to two motors employed in the third embodiment, for driving various rollers and that a gear mechanism is disposed for driving and stopping the various rollers. The same components as those of the third embodiment will be denoted by the same reference numerals and the description thereof will be omitted to avoid duplicate description.

As described, the sheet feed device 3 of the third embodiment includes the first motor 71A, the second motor 71B and the control unit 23. The firs motor 71A drives the sheet feed roller 63. The second motor 71B drives both the transportation roller 67*a* and the discharge roller 69. The control unit 23 controls rotations of the first and second motors 71A and 71B. In contrast, the sheet feed device 4 of the fourth embodiment employs a single motor 71C for driving all these rollers. Specifically, the sheet feed roller 63, the transportation roller 67*a*, and the discharge roller 69 are rotated by the motor 71C via a gear mechanism 72. The control unit 73 controls rotations of the motor 71C.

The gear mechanism 72 is constructed to selectively transmit rotations of the motor 71C to the rollers. When the motor 71C makes forward rotations, the rotations of the motor 71C are transmitted to the sheet feed roller 63, the transportation roller 67*a*, and the discharge roller 69 to rotate these rollers in directions to move the sheet 62 from the paper storage 75 to the discharge tray 70 via the print head 68. On the other hand, when the motor 71C makes reverse rotations, the rotations of the motor 71C are transmitted only to the transportation roller 67*a* and the discharge roller 69 to move the sheet 62 toward the discharge tray 70. That is, when the motor 71 makes reverse rotations, the sheet feed roller 63 is not driven but placed in a freely rotatable condition.

The gear mechanism 72 is constructed to change over the rotational direction of the transportation roller 67*a* with the use of an actuator, such as solenoid. When the sheet 62 is fed out by the sheet feed roller 63 toward the transportation roller 67*a*, the transportation roller 67*a* is rotated in reverse using the actuator so as not to allow the sheet 62 to pass through the nip between the transportation roller 67*a* and the pinch roller 67*b*. The leading edge of the sheet 62 is brought into abutment with the nip therebetween, thereby preventing occurrence of oblique feeding of the sheet 62. It should be noted that control for changing over the rotational direction of the motor 71C is implemented by the control unit 73.

Operation of the fourth embodiment will be described in detail while referring to FIGS. 11A and 11B.

When the sheet feed operation with the sheet feed device 4 is started, the motor 71C is forwardly driven to rotate the drive gear 87. In accordance with rotations of the drive gear 87, the intermediate gear 87 is rotated and moves toward the idle gear 81. When the intermediate gear 87 is brought into meshing engagement with the idle gear 81, the rotations of the intermediate gear 87 are transmitted to the sheet feed roller 63 to rotate the latter. The sheet feed roller 63 is supported by the roller support 88 that is rotatable about the shaft of drive gear 87. Therefore, the sheet feed roller 63 is urged toward the slanted wall 61 of the paper storage 75 and is held in contact with the topmost sheet 62. As such, the topmost sheet 62 is fed out by the sheet feed roller 63 while being separated from the remaining sheets of paper with the aid of the sheet separator 82. When the sheet 62 is fed out with the sheet feed roller 63, the transportation roller 67*a* and the discharge roller 69 are being rotated forwardly to convey the sheet 62 in the paper transportation direction by virtue of the gear mechanism 72.

When the motor 71C is rotated in reverse, the sheet feed roller 63 and the idle gear 81 are not rotated by the rotational power of the motor 71C because the intermediate gear 84 is disengaged from the idle gear 81. Instead, the sheet feed roller 63 and the idle gear 81 are rotated due to frictional contact with the moving sheet 62.

In accordance with rotations of the idle gear 81, the disk 86 rotates and the rotation sensor 64 senses the rotations of the disk 86. The control unit 23 receives the output from the rotation sensor 64 and determines the trailing edge of the sheet 62.

Figure 13:
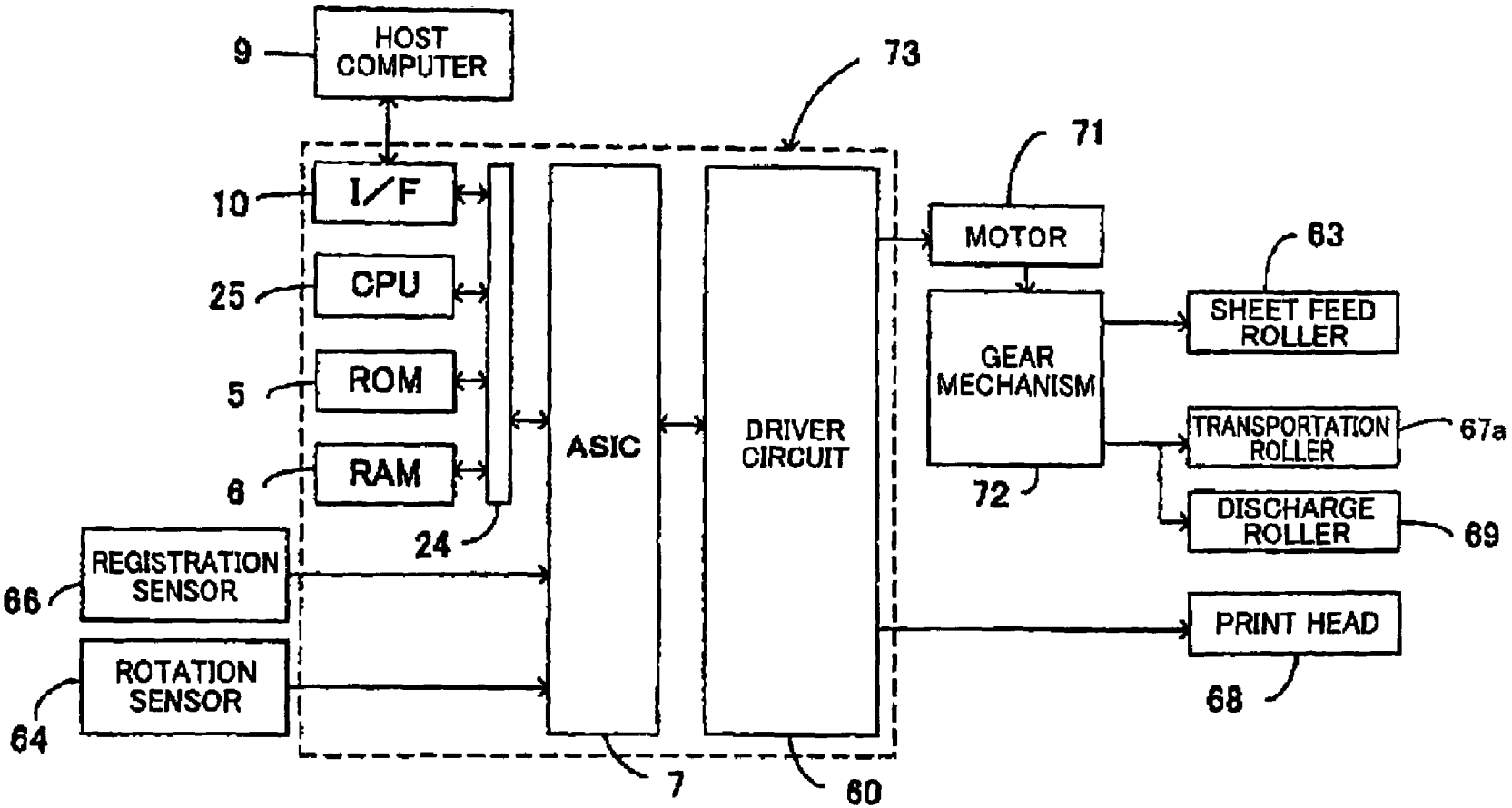
FIG. 13 is a block diagram showing a control unit and components connected thereto in accordance with the fourth embodiment of the invention.

Next, the control unit 73 will be described with reference to FIG. 13. As shown therein, the structure of the control unit 73 is identical to that shown in FIG. 4. However, in accordance with the fourth embodiment, the drive circuit 60 of the control unit 73 controls only one motor and controls the rotational direction of the motor 71C.

Figure 14:
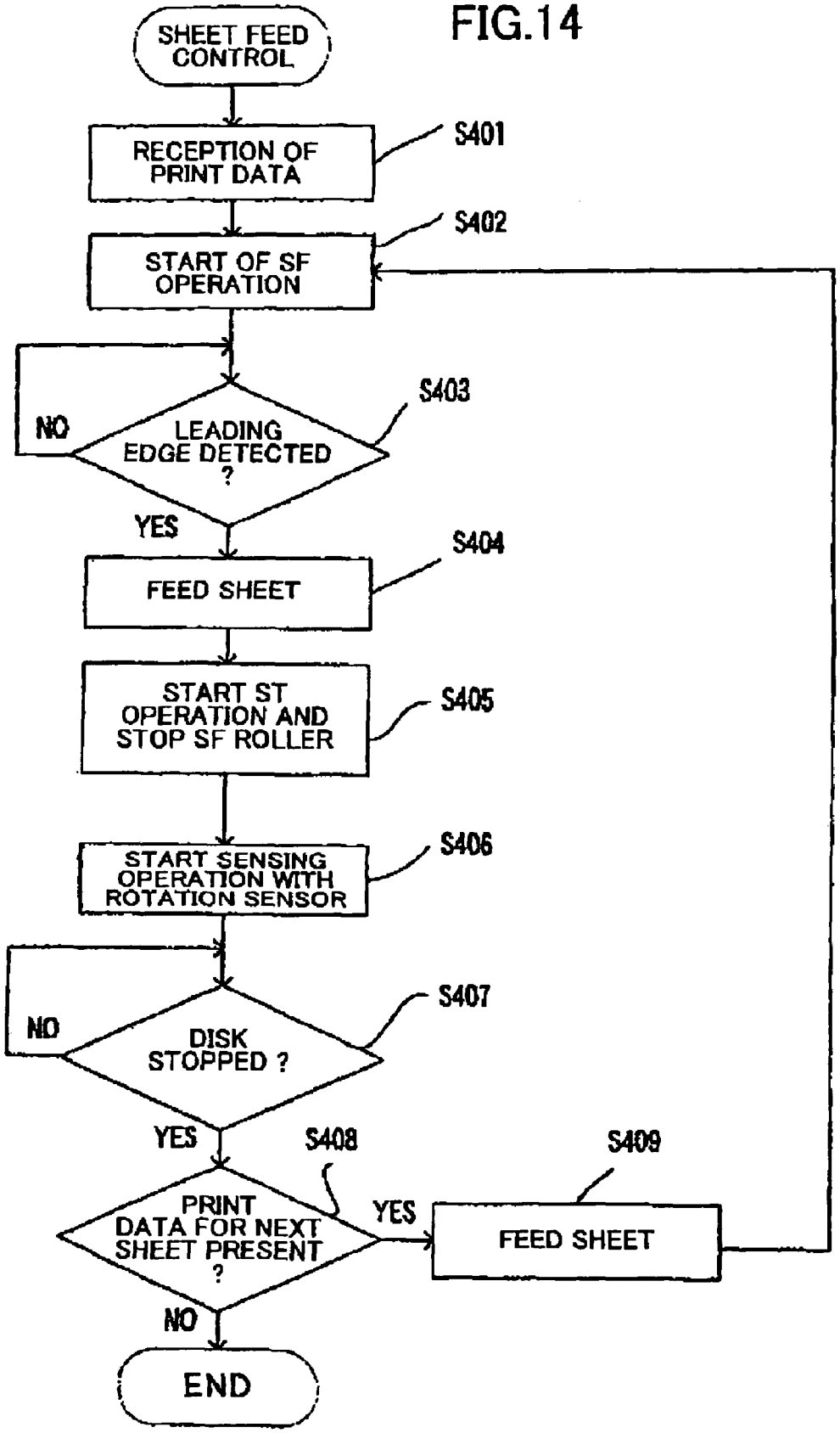
FIG. 14 is a flowchart showing operational sequence of the sheet feed operation performed by the control unit of the fourth embodiment of the invention.

Sheet feed operation performed by the sheet feed device 4 in accordance with the fourth embodiment will be described while referring to the flowchart shown in FIG. 14.

When the control unit 73 receives the print data from the host computer 9 (S401), sheet feed (SF) operation is started (S402). In the sheet feed operation, the driver circuit 60 supplies the drive signal to the motor 71C to rotate it in the forward direction. In accordance with forward rotations of the motor 71C, the sheet feed roller 63, the transportation roller 67*a* and the discharge roller 69 rotate via the gear mechanism 72 to feed out the topmost sheet stacked in the paper storage 75. Then, determination is made as to whether or not the registration sensor 66 senses the leading edge of the sheet 66 (S403). When the leading edge of the sheet 66 is sensed by the registration sensor 66 (S403: YES), the sheet feed roller 63 further feeds the sheet 66 a predetermined distance (S404). The predetermined distance is such a distance necessary to relay the sheet 66 to the transportation roller 67*a* after sensing the leading edge of the sheet 66 by the registration sensor 66.

Next, the routine proceeds to S405 where sheet transportation (ST) operation is started. Upon start of the sheet transportation operation, the motor 71C is rotated in reverse to transport the sheet 62 that is brought into abutment with the nip between the transportation roller 67*a* and the pinch roller 67*b*. At this time, the driving of the sheet feed roller 3 is interrupted and the transportation operation is performed only by the transportation roller 67*a* and the discharge roller 69.

When the driving of the sheet feed roller 63 is interrupted, the rotation sensor 64 starts sensing rotations of the disk 86 (S406). The rotation sensor 64 continuously senses the rotations of the disk 86 until the disk 86 stops its rotations (S407). The fact that the disk 86 is stopped (S407: YES) instructs the control unit 73 that the trailing edge of the sheet of paper 62 is sensed.

When the trailing edge of the sheet 62 is detected in S407, the routine proceeds to S408 where the control unit 73 determines whether or not there is further print data to be printed on the subsequent sheet of paper 62. When there is no print data, the driving of the motor 71C is stopped and the routine is hereby ended upon completion of printing on the sheet 62 currently being subject to printing and discharging the printed sheet 62 onto the discharge tray 70 by means of the discharge roller 69. On the other hand, when there remains print data outstanding for further printing on the subsequent sheet of paper, the routine proceeds to S409 where the sheet 62 subject to printing is fed by a prescribed distance so that a proper distance can be interposed between the trailing edge of the current sheet of paper and the leading edge of the subsequent sheet of paper. Then, the routine returns to S402 where sheet feed operation for the subsequent sheet is started. In the fourth embodiment, the sheet feed amount in S409 is determined while taking into account a distance between the lower edge of the sheet 62 that is in contact with the sheet separator 82 and a contact point of the sheet feed roller 63 with the sheet 62.

As described, the sheet feed device 4 driven by a single motor 71C is capable of controlling various rollers with the use of the gear mechanism 72. Further, the trailing edge of the sheet 62 can be detected based on the fact that the sheet feed roller 62, that is rotated by the frictional contact with the sheet 62 being conveyed by the transportation roller 67*a*, stops its rotations. As such, the trailing edge of the sheet 62 can be detected before it is completely fed out from the sheet storage 75. Therefore, the interval between the two successively fed cut sheets can be shortened while maintaining the interval at constant, so the sheet feeding efficiency is improved. Further, detection of the trailing edge of the sheet is performed for each sheet of paper, therefore, the interval between the two successively fed cut sheets can be set to a fixed and shortened distance even if there are variations in length of the sheet. Moreover, with the use of the rotation sensor 64 and other sensor, such as a position sensor, detection of paper jam can be performed.

While the invention has been described in detail with reference to specific embodiments thereof, it would be apparent to those skilled in the art that various changes and modifications may be made therein without departing from the spirit of the invention, the scope of which is defined by the attached claims.

For example, throughout the various embodiments and their modifications, the transportation roller may perform the oblique-feed prevention operation for only the firstly fed sheet and may not perform that operation for the rest of the sheets. It is preferable to apply this type of control to the sheet feed devices in accordance with the first to third embodiments and their modifications. Alternatively, the transportation roller may perform the oblique-feed prevention operation for all the sheets. It is preferable to apply this type of control to the sheet feed device in accordance with the fourth embodiment and its modifications.

What is claimed is:

1. A sheet feed device comprising:

a sheet accommodating unit for accommodating a plurality of cut sheets in a stacked condition;

a sheet feed roller that feeds a cut sheet accommodated in the sheet accommodating unit, the cut sheet having a leading edge and a trailing edge defined in relation to a sheet feed direction in which the cut sheet is fed by the sheet feed roller;

a trailing edge detector that detects the trailing edge of the cut sheet and outputs a detection signal indicative of the detection of the trailing edge; and a control unit that determines a timing at which a subsequent cut sheet is fed out by the sheet feed roller based on the detection, wherein the trailing edge detector comprises a conversion mechanism that converts movement of the cut sheet into rotations, wherein the sheet feed roller is a sector roller having a rotational shaft to be rotatable with the sector roller, and wherein the trailing edge detector comprises a collar shaft, a collar fixedly attached to the collar shaft to be rotatable with the collar shaft, a disk coaxially attached to the collar shaft, and a rotation sensor that detects rotations of the disk, wherein the sector roller feeds the cut sheet during a first phase of one rotation and does not feed the cut sheet during a second phase of one rotation, and the collar rotates during the second phase and does not rotate during the first phase, the detection signal being generated when the rotation sensor no longer detects the rotations of the disk.

2. The sheet feed device according to claim 1, wherein the trailing edge detector is disposed in a position upstream of the sheet feed roller with respect to the sheet feed direction.

3. The sheet feed device according to claim 1, wherein the sheet feed roller is disposed in a first position upstream of the leading edge of the cut sheet accommodated in the sheet accommodating unit and the trailing edge detector is disposed in a second position further upstream of the sheet feed roller with respect to the sheet feed direction.

4. The sheet feed device according to claim 1, wherein the sheet feed roller has the rotational shaft to be rotatable with the sheet feed roller, and the trailing edge detector is coaxially attached to the rotational shaft.

5. The sheet feed device according to claim 1, wherein the sheet feed roller has the rotational shaft to be rotatable with the sheet feed roller, and the trailing edge detector is operatively coupled to the rotational shaft.

6. The sheet feed device according to claim 5, wherein the trailing edge detector comprises the disk coaxially attached to the rotational shaft, and the rotation sensor that detects rotations of the disk.

7. The sheet feed device according to claim 1, further comprising a motor operatively coupled to the sheet feed roller, the sheet feed roller being rotated by rotational power of the motor when the motor is energized and being freely rotatable when the motor is deenergized.

8. A sheet feed device comprising:

a sheet accommodating unit for accommodating a plurality of cut sheets in a stacked condition;

a first roller that feeds a cut sheet accommodated in the sheet accommodating unit, the cut sheet having a leading edge and a trailing edge defined in relation to a sheet feed direction in which the cut sheet is fed by the first roller;

a trailing edge detector that detects the trailing edge of the cut sheet and outputs a detection signal indicative of the detection of the trailing edge;

a second roller disposed downstream of the first roller with respect to the sheet feed direction, wherein the second roller starts conveying the cut sheet when the first roller stops feeding the cut sheet, and the trailing edge detector starts detecting the trailing edge of the cut sheet when the first roller stops feeding the cut sheet; and a control unit that determines a timing at which a subsequent cut sheet is fed out by the first roller based on the detection, wherein the trailing edge detector comprises a conversion mechanism that converts movement of the cut sheet into rotations, wherein the first roller is a sector roller having a rotational shaft to be rotatable with the sector roller, and wherein the trailing edge detector comprises a collar shaft, a collar fixedly attached to the collar shaft to be rotatable with the collar shaft, a disk coaxially attached to the collar shaft, and a rotation sensor that detects rotations of the disk, wherein the sector roller feeds the cut sheet during a first phase of one rotation and does not feed the cut sheet during a second phase of one rotation, and the collar rotates during the second phase and does not rotate during the first phase, the detection signal being generated when the rotation sensor no longer detects the rotations of the disk.

9. The sheet feed device according to claim 8, wherein the trailing edge detector is disposed in a position upstream of the first roller with respect to the sheet feed direction.

10. The sheet feed device according to claim 8, wherein the first roller is disposed in a first position upstream of the leading edge of the cut sheet accommodated in the sheet accommodating unit and the trailing edge detector is disposed in a second position further upstream of the first roller with respect to the sheet feed direction.

11. The sheet feed device according to claim 8, wherein the first roller has the rotational shaft to be rotatable with the first roller, and the trailing edge detector is coaxially attached to the rotational shaft.

12. The sheet feed device according to claim 8, wherein the first roller has the rotational shaft to be rotatable with the first roller, and the trailing edge detector is operatively coupled to the rotational shaft.

13. The sheet feed device according to claim 12, wherein the trailing edge detector comprises the disk coaxially attached to the rotational shaft, and the rotation sensor that detects rotations of the disk.

14. The sheet feed device according to claim 8, further comprising a motor operatively coupled to the first roller, the first roller being rotated by rotational power of the motor when the motor is energized and being freely rotatable when the motor is deenergized.

* * * * *